US009153107B2

(12) United States Patent
Austin

(10) Patent No.: US 9,153,107 B2
(45) Date of Patent: Oct. 6, 2015

(54) MULTI-SENSORY ALARMING DEVICE

(76) Inventor: Kathleen A. Austin, Milford, NJ (US)

( * ) Notice: Subject to any disclaimer, the term of this patent is extended or adjusted under 35 U.S.C. 154(b) by 260 days.

(21) Appl. No.: 12/208,161

(22) Filed: Sep. 10, 2008

(65) Prior Publication Data

US 2010/0060466 A1 Mar. 11, 2010

(51) Int. Cl.
*G08B 1/08* (2006.01)
*G08B 6/00* (2006.01)

(52) U.S. Cl.
CPC ..... *G08B 6/00* (2013.01)

(58) Field of Classification Search
CPC ..... G08B 6/00
USPC ..... 340/539.27
See application file for complete search history.

(56) References Cited

U.S. PATENT DOCUMENTS 3,969,720 A * 7/1976 Nishino ..... 340/815.69
4,297,677 A * 10/1981 Lewis et al. ..... 340/540
4,380,759 A 4/1983 Sulkoski et al.
4,853,674 A * 8/1989 Kiss ..... 340/407.1
4,914,422 A * 4/1990 Rosenfield et al. ..... 340/573.1
5,019,805 A 5/1991 Curl et al.
5,045,833 A 9/1991 Smith
5,663,714 A 9/1997 Fray
5,867,105 A * 2/1999 Hajel ..... 340/691.3
6,344,795 B1 * 2/2002 Gehlot ..... 340/540
7,109,879 B2 * 9/2006 Stults et al. ..... 340/691.1
2004/0217859 A1 * 11/2004 Pucci et al. ..... 340/539.32
2007/0008153 A1 1/2007 Albert
2008/0048873 A1 * 2/2008 Araiza-Boys ..... 340/601
2009/0029716 A1 * 1/2009 Thomas ..... 455/456.1

* cited by examiner

*Primary Examiner* — Kerri McNally
(74) *Attorney, Agent, or Firm* — Schmeiser, Olsen & Watts LLP

(57) ABSTRACT

An alarming device including: a power module, a trigger module, a heat module, a noise module, and a visual module. The trigger module is configured to detect an emergency and trigger an event. The heat module is functionally in communication with the power module and the trigger module and configured to project heat when triggered by the trigger module. The noise module is functionally in communication with the power module and the trigger module and configured to project sound when triggered by the trigger module. The visual module is functionally in communication with the power module and the trigger module and configured to project light when triggered by the trigger module.

17 Claims, 6 Drawing Sheets

MULTI-SENSORY ALARMING DEVICE

BACKGROUND OF THE INVENTION

1. Field of the Invention

The present invention relates to alarming devices and, more particularly, to alarming devices that alert through stimulating multiple human senses.

2. Description of the Related Art

Alarming devices protect people from a variety of dangers. Examples of common household alarming devices include smoke detectors, carbon-monoxide detectors and burglar alarms. In addition to warning of danger, alarming devices are also used to alert people of events. For example, a ringing telephone alerts of an incoming telephone call. Similarly, a doorbell alerts that a person at the door.

Often alarming devices produce an auditory signal as a means to alert, but for the deaf and hard of hearing, auditory alarming devices do not suffice. Similar problems arise for the blind with alarming devices that produce light as a means to alert. Some improvements have been made in the field. Examples of references related to the present invention are described below, and the supported teachings of each reference are incorporated by reference herein:

U.S. Patent Application Publication No. 2007/0008153 to Albert discloses a way home safety and security are provided using a bedside unit to monitor an audible personal security pendant and to send notification signals to the appropriate communication site. Improved reliability is achieved by comparing a stored signal signature to the real time digital pattern representing sounds received using digital acoustic signature recognition technology.

U.S. Pat. No. 5,663,714 to Fray discloses an alarm system, comprising a smoke detector, a smoke detector output relay, a recording switch, a microphone, a digital recording and a play back device, a timer/pulse generator, a pulse counter, a number of speakers, an amplifier and an alarm tone generator, and the method of operation of the alarm system are presented. The smoke detector output relay activates a printed circuit that is powered off the smoke detector at two different points. The recording switch, when activated, allows a voice message to be recorded through the microphone on a digital recording and play back device. The timer/pulse generator starts when activated by the smoke detector output relay. The timer/pulse generator then sends timed pulses to the pulse counter that controls output of the digital recording and play back device, i.e. a verbal message, and of the alarm tone generator. The controlled output of the digital recording and play back device and of the alarm tone generator is then sent to the amplifier. Then, the output of the amplifier is sent to the number of speakers which send messages and tones, alerting by standing individuals of presence of fire or smoke. The messages and tones may be repeated until the alarm system is reset.

U.S. Pat. No. 4,380,759 to Sulkoski, et al. discloses an apparatus to alert a deaf person made up of an alarm device such as a smoke detector adapted to vibrate when actuated by smoke and a transmitter having a vibration sensor connected to the transmitter. The vibration sensor is supported in engagement with the smoke detector and adapted to sense the vibrations of the smoke detector and to transmit a signal to a remotely located receiver. The receiver has a vibrating reed with a tacticle member on its end for engaging a person to alert him when the receiver causes the reed to be vibrated.

U.S. Pat. No. 5,019,805 to Curl, et al. discloses a smoke detector of the designed to warn hearing impaired persons of fire or smoke. A small, attractive, and inexpensive wall or ceiling mounted unit houses a dual chamber ionization detector, piezoelectric alarm horn, and a high intensity xenon strobe unit producing approximately 130 candela. In one embodiment, it is powered only from standard 120 volt AC power, although an internal battery standby version and low voltage D.C. version are alternative embodiments. The unit is furnished with a surface mount housing. It can easily be moved from room to room as required and it is intended to be easily hung on the wall about a foot from the ceiling.

U.S. Pat. No. 5,045,833 to Smith discloses an improved actuator device which comprises a combination of activators, switches, indicator lights and power outlets for providing an alarm to those persons of impaired hearing. The device comprises a housing which has electrical power supplied thereto and switches for transmitting the received electrical power therefrom. An indicator circuit is provided to signal the activation capability of the device. Associated with the device is a pneumatic pressure switch which is activated when increased pneumatic pressure is applied to the switch, pressure being applied through a squeeze bulb and tubular conduit connecting the squeeze bulb to the switch. Other indicators and sensor switches can be associated with the device to alert one of impaired hearing to multiple dangerous situations or events.

The inventions heretofore known suffer from a number of disadvantages which include: not adequately alerting sensory impaired people, not adequately directing the person to safety and not adequately directing emergency personnel to the person.

What is needed is an alarming device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available alarming devices. Accordingly, the present invention has been developed to provide a multi-sensory alarming device.

In a first implementation, an alarming device is provided, which includes: a power module, a trigger module, a heat module, a noise module, and a visual module. The trigger module is configured to detect an emergency and trigger an event. The heat module is functionally in communication with the power module and the trigger module and configured to project heat when triggered by the trigger module. The noise module is functionally in communication with the power module and the trigger module and configured to project sound when triggered by the trigger module. The visual module is functionally in communication with the power module and the trigger module and configured to project light when triggered by the trigger module.

One or more of the following features may be included in an embodiment of the invention. The alarming device may further include a wrist band configured to be selectably disposed about a wrist of a person, wherein the heat module, the noise module, and the visual module are coupled to the wrist band. The alarming device may further include a bed mount configured to be coupled to a bed, wherein the heat module, the noise module, and the visual module are coupled to the bed mount. The alarming device may further include a vibration module functionally in communication with the power module and the trigger module and configured to project physical vibrations when triggered by the trigger module. The alarming device may further include a scent module functionally in communication with the power module and the trigger module and configured to project a scent when triggered by the trigger module. The alarming device may be such that the trigger module is either a smoke detector, a heat detector, a carbon-monoxide detector, a burglar alarm, a telephone, a medical emergency detecting device, and an emergency weather condition alarming device. The noise module may be a buzzer. The noise module may be a speaker that indicates an emergency type that triggered the event. The visual module and the vibration module may each indicate an emergency type that triggered the event. The trigger module may be wired to the noise module, the visual module, and the heat module. The alarming device may further include a wireless module configured to wirelessly connect the trigger module with the noise module, the visual module, and the heat module. The alarming device may further include a location module functionally in communication with the power module and configured to amplify output of the noise module, the visual module, and the heat module when the location module is in closer proximity to the emergency. The alarming device may further include an ankle band configured to be selectably disposed about an ankle of a person, wherein the heat module, the noise module, and the visual module are coupled to the ankle band. The alarming device may be fire resistant.

Reference throughout this specification to features, advantages, or similar language, does not imply that all of the features and advantages that may be realized with the present invention should be, or are, in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages and characteristics of the invention may be combined in any suitable manner in one or more embodiments. One skilled in the relevant art will recognize that the invention can be practiced without one or more of the specific features, or advantages, of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations not intended to portray specific parameters of the invention. Understanding that these drawing(s) depict only typical embodiments of the invention and are not, therefore, to be considered limiting its scope, the invention will be described and explained with additional specificity and detail through the use of the accompanying drawing(s) in which.

DETAILED DESCRIPTION OF THE INVENTION

Figure 1:
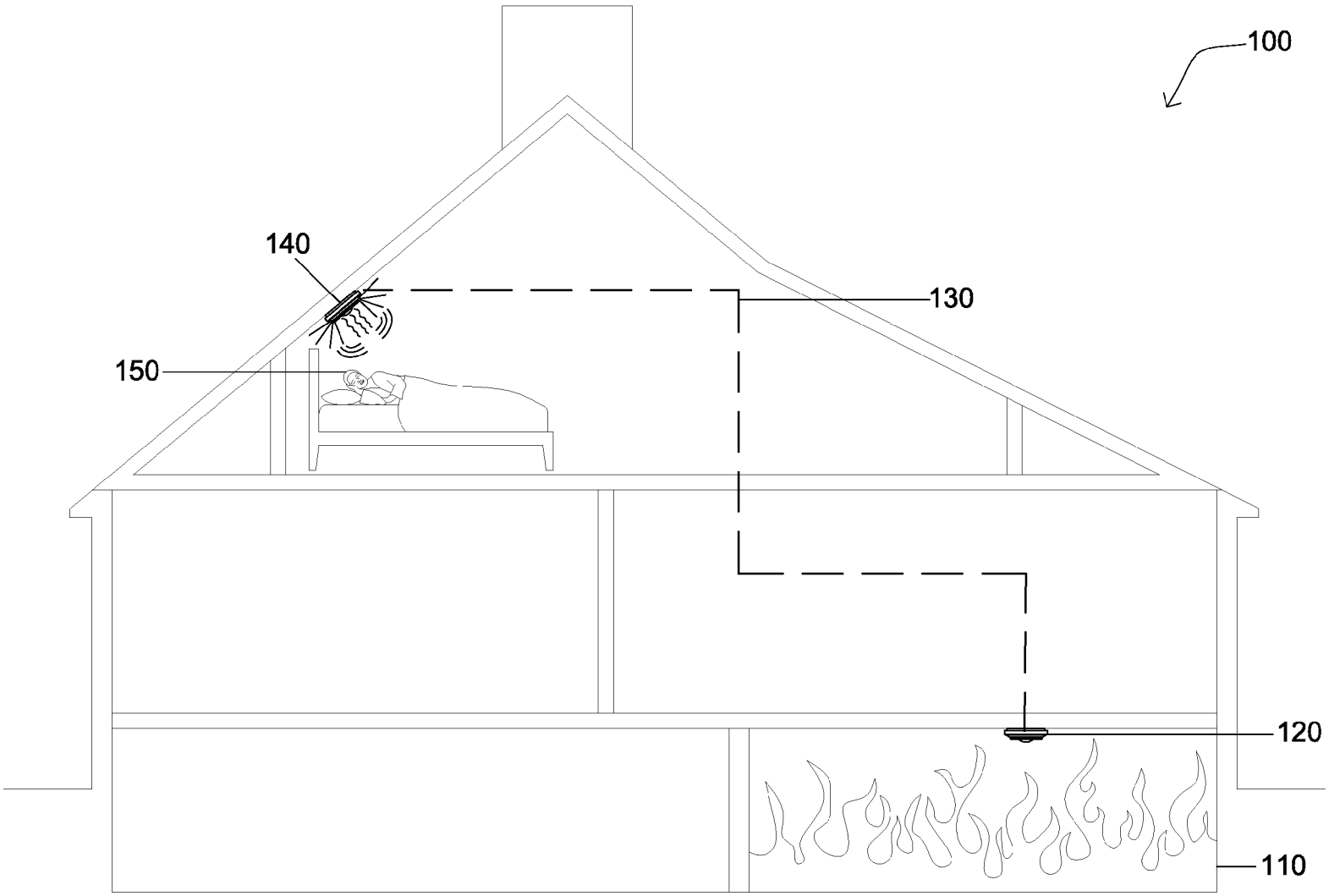
FIG. 1 illustrates an alarming device in use, including communication with a smoke detector, according to one embodiment of the invention.

For the purposes of promoting an understanding of the principles of the invention, reference will now be made to the exemplary embodiments illustrated in the drawing(s), and specific language will be used to describe the same. It will, nevertheless, be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof, described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole, or in part, one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Many of the functional units described in this specification have been labeled as modules, in order to more particularly emphasize their implementation independence. For example, a module may be implemented as a hardware circuit comprising custom VLSI circuits, or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions, which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server or other computing systems, including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. As those skilled in the art will appreciate, any computers discussed herein may include an operating system (e.g., Windows Vista, NT, 95/98/2000, OS2; UNIX; Linux; Solaris; MacOS; and etc.), as well as various conventional support software and drivers typically associated with computers. The computers may be in a home or business environment with access to a network. In an exemplary embodiment, access is via the Internet through a commercially-available web-browser software package.

The present invention may be described herein in terms of functional block components, screen shots, user interaction, optional selections, various processing steps and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components; e.g., memory elements, processing elements, logic elements, look-up tables and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control and the like. Still further, the invention may detect or prevent security issues with a client-side scripting language, such as JavaScript, VBScript or the like.

Additionally, many of the functional units and/or modules herein are described as being "in communication" with other functional units and/or modules. Being "in communication" refers to any manner and/or way in which functional units and/or modules such as, but not limited to, computers, laptop computers, PDAs, modules, and other types of hardware and/or software that may be in communication with each other. Some non-limiting examples include communicating, sending, and/or receiving, data and metadata via: a network, a wireless network, software, instructions, circuitry, phone lines, internet lines, satellite signals, electric signals, electrical and magnetic fields and/or pulses and/or so forth.

As used herein, the term "network" may include any electronic communication means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

FIG. 1 illustrates an alarming device in use, including communication with a smoke detector, according to one embodiment of the invention. A house 100 is shown with a fire 110 in one room of the house 100. Since there is a smoke detector 120 with a connection 130 to an alarming device 140, a sensory impaired sleeping person 150 located in another room of the house may be alerted of the dangerous fire.

Although the sensory impaired sleeping person 150 may have one or more impaired senses, the sensory impaired sleeping person 150 may still be alerted. As shown by emitting lines, the alarming device stimulates multiple senses by emitting light, sound, heat, and other sensory stimuli. The configuration thus alerts the sensory impaired sleeping person 150 despite the sensory impaired sleeping person 150 having impaired sense or senses.

Figure 2:
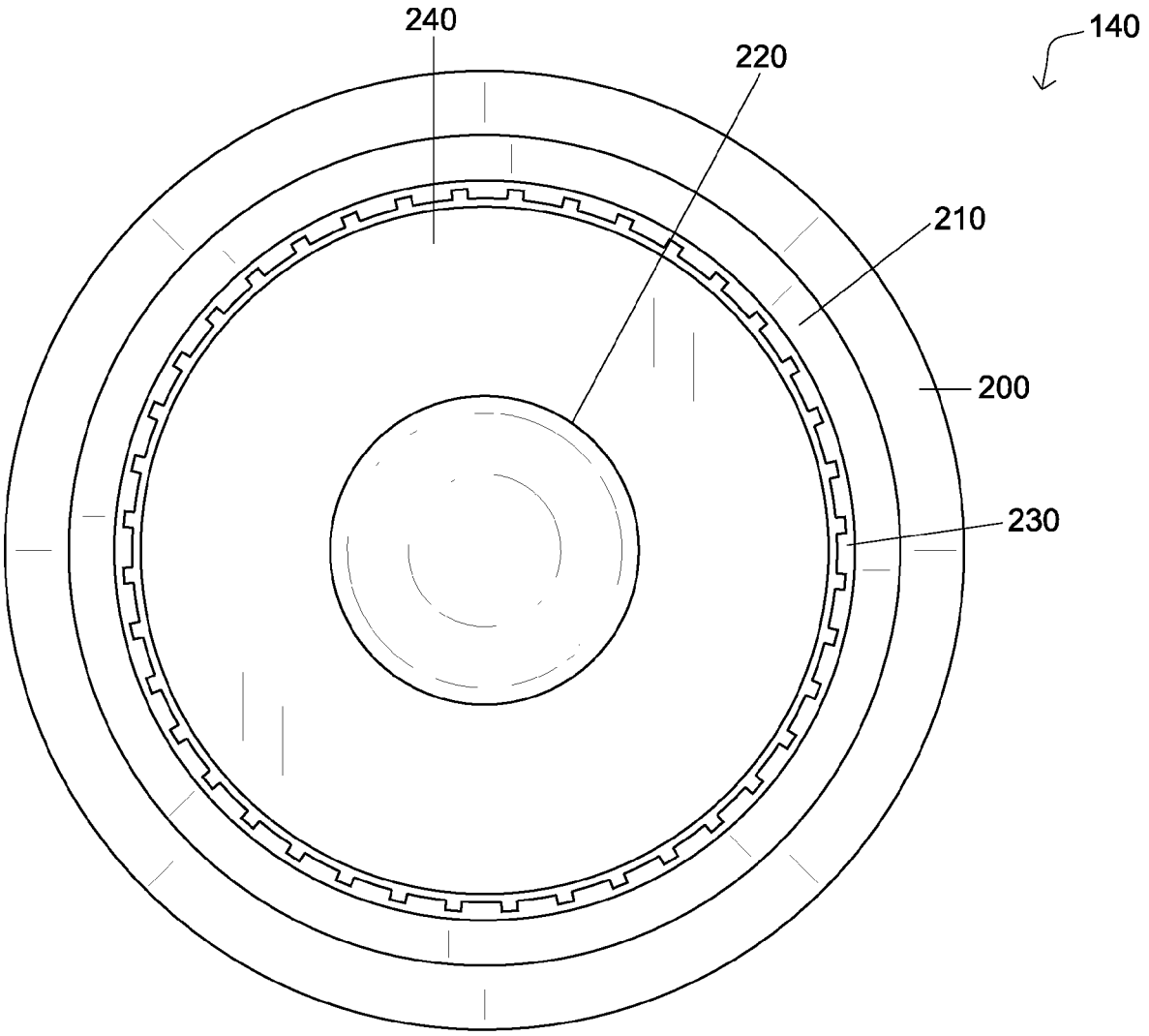
FIG. 2 is a front view of an alarming device, according to one embodiment of the invention.
Figure 3:
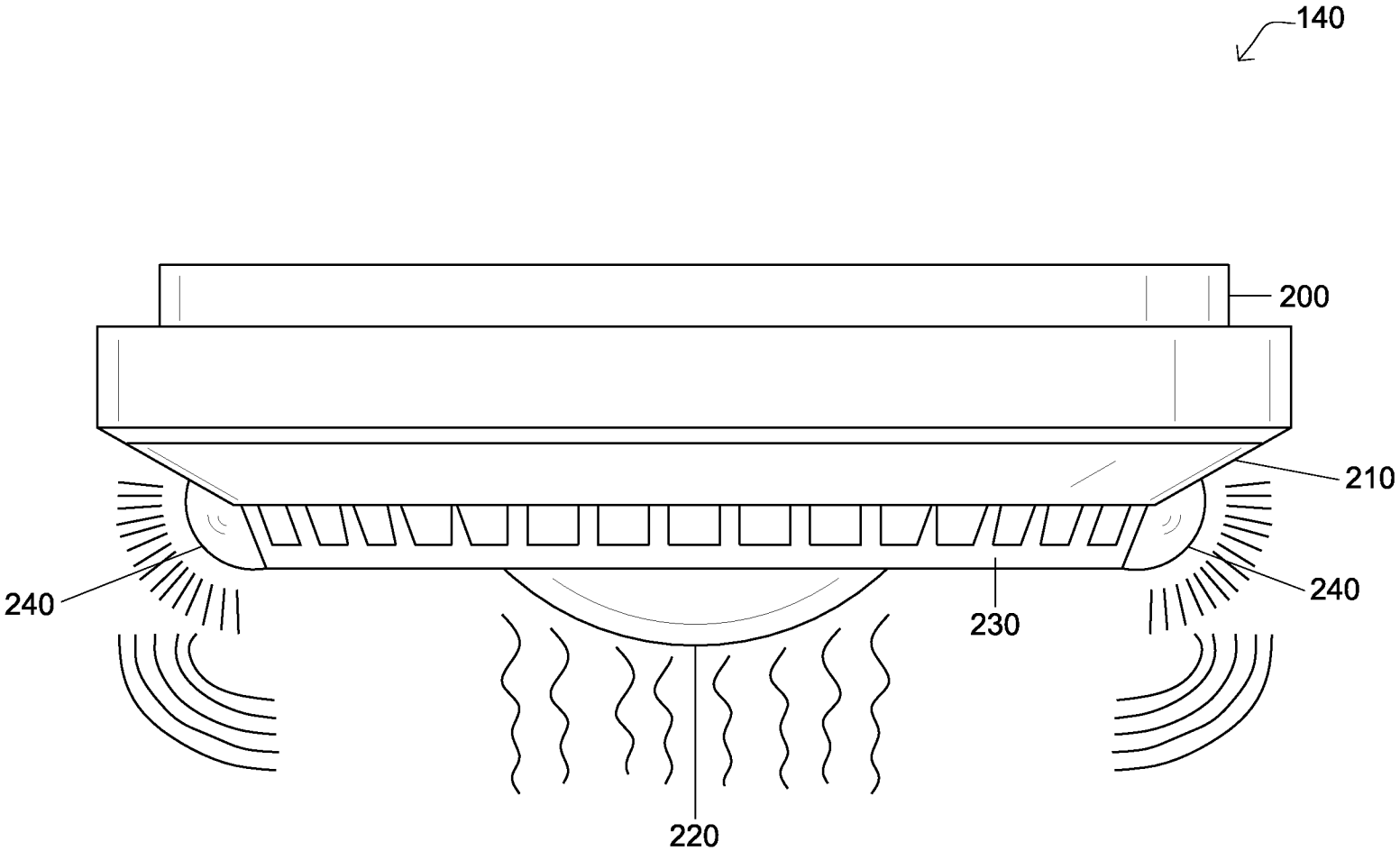
FIG. 3 is a side view of an alarming device, according to one embodiment of the invention.
Figure 4:
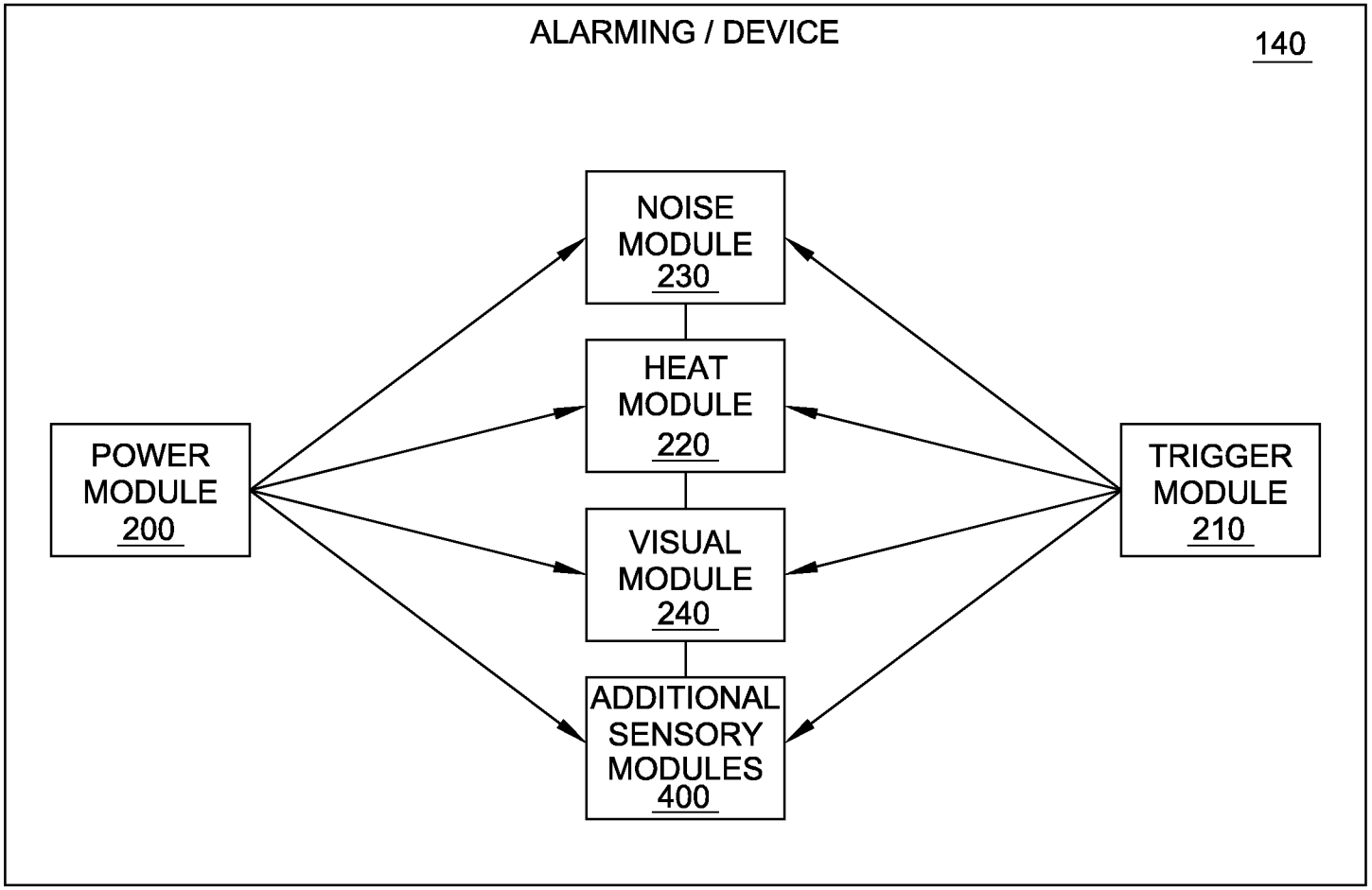
FIG. 4 is a block diagram of an alarming device, according to one embodiment of the invention.

FIGS. 2 and 3 are views of an alarming device, according to one embodiment of the invention. In addition, FIG. 4 is a block diagram of an alarming device, according to one embodiment of the invention. An alarming device 140 is shown, including: a power module 200, a trigger module 210 configured to detect an emergency and trigger an event, a heat module 220, a noise module 230, and a visual module 240. The heat module 220, the noise module 230, and the visual module 240 are functionally in communication with the power module 200 and the trigger module 210, and are configured to project their respective stimuli when triggered by the trigger module 210.

The power module 200 may be any system or device which outputs electric power, and thus has the ability to provide power to the various modules of the alarming device.

Examples of systems or devices that may be used in, or as, the power module 200, include, but are not limited to, batteries, transformers, and solar cells. Further, the power module 200 may be any combination of devices that output electric power. An example of a power module can be found in U.S. Pat. No. 4,712,160 to Sato et al., the teachings of which are incorporated by reference herein.

The trigger module 210 may, or may not, need power from the power module, and thus may, or may not, need to be functionally in communication with the power module. For example, some heat detectors such as those found in commercial fire sprinkler systems usually are not powered by electricity. Rather, these heat detectors are configured to detect heat and break open pressurized water when the surrounding heat reaches a certain temperature. The trigger module 210 may use such a system or device, or may use any system or device which is configured to detect an emergency and trigger an event. A non-limiting example of other systems or devices that may be used in, or as, the trigger module 210 include: smoke detectors, heat detectors, carbon-monoxide detectors, burglar alarms, telephones, medical emergency detecting devices or systems, and emergency weather condition alarming devices or systems. An example of a trigger module can be found in U.S. Pat. No. 4,617,560 to Gutmann, the teachings of which are incorporated by reference herein.

The heat module 220, the noise module 230, and the visual module 240 are functionally in communication with the trigger module 210. This communication may be effectuated by mechanical, electrical, or electromechanical means. For instance, the trigger module 210 may be wired to the noise module 230, the visual module 240, and the heat module 220. The wiring thus provides a path for an electrical signal from the trigger module to travel to, and communicate with, the heat module 220, the noise module 230 and the visual module 240. As another example, the alarming device may further include a wireless module configured to wirelessly connect the trigger module 210 with the noise module 230, the visual module 240 and the heat module 220. An example of a wireless module can be found in, U.S. Pat. No. 4,696,054 to Tsugei et al., the teachings of which are incorporated by reference herein.

The heat module 220 may be any known article that produces heat. Examples include, but are not limited to, heat lamps, space heaters, and radiating heaters. The heat produced should be hot enough to alert the person of the looming danger or event. An example of a heat module can be found in U.S. Pat. No. 4,716,658 to Jacobi, the teachings of which are incorporated by reference herein. Similarly, the noise module 230 may be any known article that produces noise. Examples include, but are not limited to, buzzers, speakers and sirens. The noise produced should be loud enough to alert the person of the looming danger or event. If the noise module 230 is a speaker, the speaker may further indicate the emergency type that triggered the event. An example of a noise module can be found in U.S. Pat. No. 4,646,063 to Carson, the teachings of which are incorporated by reference herein. Likewise, the visual module may be any known article that produces light, and may indicate the emergency type that triggered the event. An example of a visual module can be found in U.S. Pat. No. 4,357,595 to Gosswiller, the teachings of which are incorporated by reference herein.

The alarming device 140 may further include additional sensory modules 400. For example, the alarming device 140 may include a vibration module functionally in communication with the power module 200 and the trigger module 210 and configured to project physical vibrations when triggered by the trigger module 210. An example of a vibration module can be found in U.S. Pat. No. 3,920,135 to Wetzel, the teachings of which are incorporated by reference herein. As another example, the alarming device 140 may further include a scent module functionally in communication with the power module 200 and the trigger module 210 and configured to project a scent when triggered by the trigger module 210. An example of a scent module can be found in U.S. Pat. No. 4,603,030 to McCarthy, the teachings of which are incorporated by reference herein. Like the noise module 230, the heat module 220, and the visual module 240, the additional sensory modules 400 may be either wired, or wireless, or in functional communication by any other mechanical, electrical, or electromechanical means. Also like the noise module 230, and heat module 220, the vibration module may indicate an emergency type that triggered the event.

The alarming device 140 may further include a location module functionally in communication with the power module 200 and configured to amplify output of the noise module 230, the visual module 240, and the heat module 220 when the location module is in closer proximity to the emergency. This may allow a sensory impaired person the opportunity to locate and avoid the emergency and thus escape.

Figure 5:
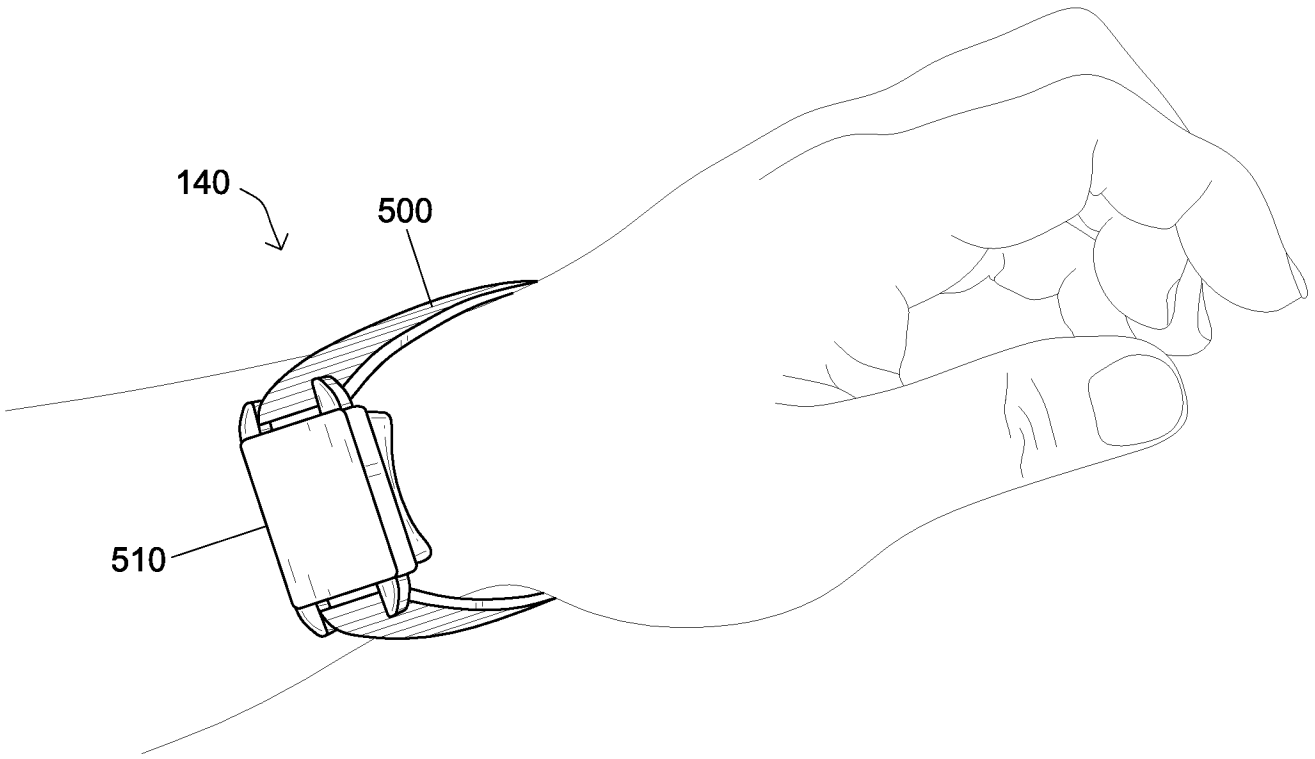
FIG. 5 illustrates a wrist with an alarming device attached thereto, according to one embodiment of the invention.
Figure 6:
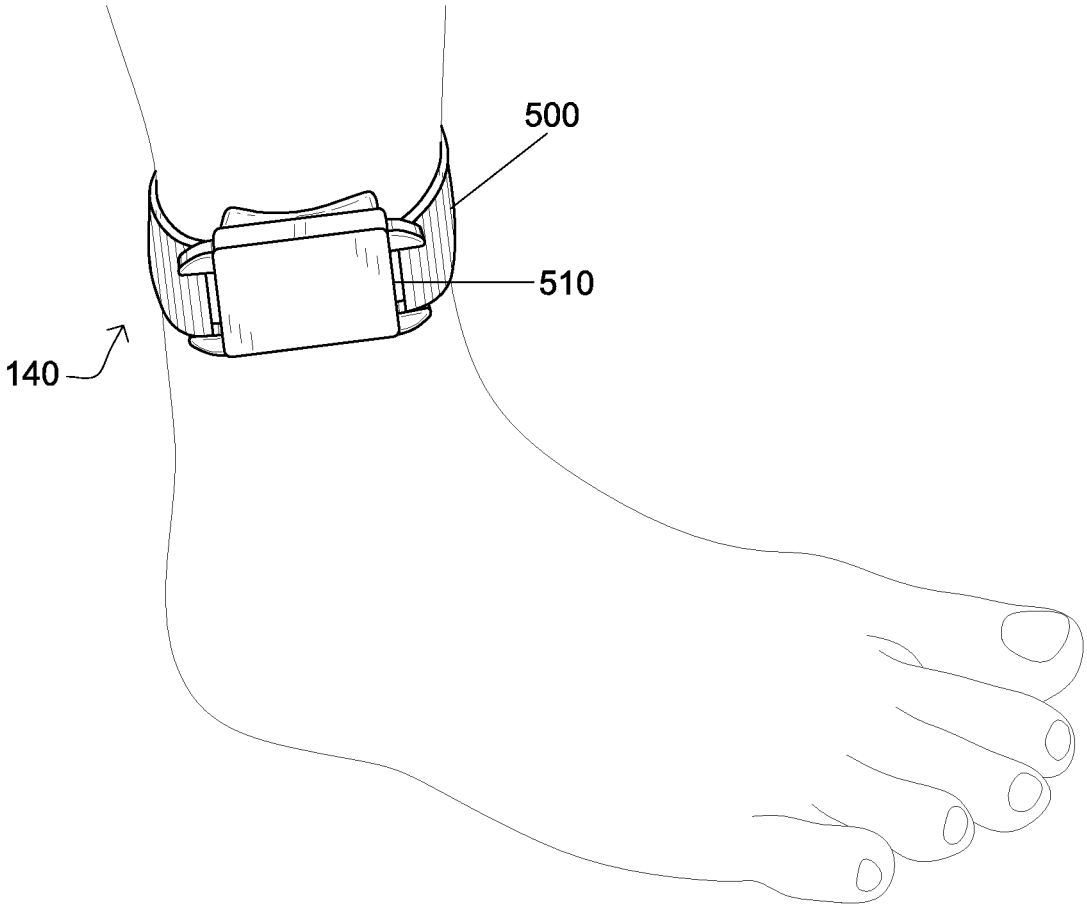
FIG. 6 illustrates an ankle with an alarming device attached thereto, according to one embodiment of the invention.

FIGS. 5 and 6 illustrate a wrist and ankle respectively, with an alarming device 140 attached thereto, according to one embodiment of the invention. As shown the alarming device 140 includes a wrist or ankle band 500 configured to be selectably disposed about a wrist or ankle of a person. The alarming device also includes a module component 510 which houses modules such as, but not limited to, the noise module 230, the heat module 220, the visual module 240 and the power module 200.

As described above, the trigger module 210 may be either wired or wireless, or in functional communication by any other mechanical, electrical, or electromechanical means. Also as described above, the alarming device 140 may further include a location module functionally in communication with the power module 200 and configured to amplify output of the noise module 230, the visual module 240, and the heat module 220 when the location module is in closer proximity to the emergency.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate a round device, the device can be any shape that has sufficient space for the enclosed modules.

It is expected that there could be numerous variations of the design of this invention. An example is that the different modules could be located remotely from one another rather than being enclosed in a single unit.

Finally, it is envisioned that the components of the device may be constructed of a variety of materials, such as fire retardant materials, plastic, or metal.

Thus, while the present invention has been fully described above with particularity and detail in connection with what is presently deemed to be the most practical and preferred embodiment of the invention, it will be apparent to those of ordinary skill in the art that numerous modifications including, but not limited to, variations in size, materials, shape, form, function and manner of operation, assembly and use may be made without departing from the principles and concepts of the invention as set forth in the claims. Further, it is contemplated that an embodiment may be limited to, consist of, or to consist essentially of, one or more of the features, functions, structures methods described herein.

What is claimed is:

1. An alarming device, comprising:

a. a power module;

b. a trigger module configured to detect an emergency and trigger an event;

c. a heat module functionally in communication with the power module and the trigger module and configured to project heat when triggered by the trigger module;

d. a noise module functionally in communication with the power module and the trigger module and configured to project sound when triggered by the trigger module;

e. a visual module functionally in communication with the power module and the trigger module and configured to project light when triggered by the trigger module; and f. a bed mount configured to be coupled to a bed, wherein the heat module, the noise module, and the visual module are coupled to the bed mount, wherein the heat module further comprises a heat lamp for projecting heat.

2. The alarming device of claim 1, further comprising:

a. a wrist band configured to be selectably disposed about a wrist of a person, wherein the heat module, the noise module, and the visual module are coupled to the wrist band.

3. The alarming device of claim 1, further comprising:

a. a vibration module functionally in communication with the power module and the trigger module and configured to project physical vibrations when triggered by the trigger module.

4. The alarming device of claim 1, further comprising:

a. a scent module functionally in communication with the power module and the trigger module and configured to project a scent when triggered by the trigger module.

5. The alarming device of claim 1, wherein the trigger module is chosen from a group consisting of: a smoke detector, a heat detector, a carbon-monoxide detector, a burglar alarm, a telephone, a medical emergency detecting device, and an emergency weather condition alarming device.

6. The alarming device of claim 1, wherein the noise module is a buzzer.

7. The alarming device of claim 1, wherein the noise module is a speaker that indicates an emergency type that triggered the event.

8. The alarming device of claim 3, wherein the visual module and the vibration module each indicates an emergency type that triggered the event.

9. The alarming device of claim 1, wherein the trigger module is wired to the noise module, the visual module, and the heat module.

10. The alarming device of claim 1, further comprising:

a. a wireless module configured to wirelessly connect the trigger module with the noise module, the visual module, and the heat module.

11. The alarming device of claim 1, further comprising:

a. An ankle band configured to be selectably disposed about an ankle of a person, wherein the heat module, the noise module, and the visual module are coupled to the ankle band.

12. The alarming device of claim 1, wherein at least one of: the power module, the trigger module, the heat module, the noise module, or the visual module; is fire resistant.

13. An alarming device, comprising:

a. a power module;

b. a trigger module configured to detect an emergency and trigger an event;

c. a heat module functionally in communication with the power module and configured to provide heat when triggered by the trigger module;

d. an alarm module chosen from the group of modules consisting of:

i. a noise module functionally in communication with the power module and configured to provide noise when triggered by the trigger module, ii. a visual module functionally in communication with the power module and configured to provide visual excitement when triggered by the trigger module, iii. a vibration module functionally in communication with the power module and configured to provide physical vibrations when triggered by the trigger module, and iv. a scent module functionally in communication with the power module and configured to provide a scent when triggered by the trigger module; and e. a bed mount configured to be coupled to a bed, wherein the heat module, and the alarm module are coupled to the bed mount, wherein the heat module further comprises a heat lamp for projecting heat.

14. The alarming device of claim 13, further comprising:

a. a wrist band configured to be selectably disposed about a wrist of a person, wherein the heat module, and the alarm module are coupled to the wrist band.

15. The alarming device of claim 13, further comprising:

a. an ankle band configured to be selectably disposed about an ankle of a person, wherein the heat module, and the alarm module are coupled to the ankle band.

16. The alarming device of claim 13, wherein the trigger module is chosen from a group consisting of: a smoke detector, a heat detector, a carbon-monoxide detector, a burglar alarm, a telephone, a medical emergency detecting device, and an emergency weather condition alarming device.

17. The alarming device of claim 13, further comprising:

a. a location module functionally in communication with the power module and configured to amplify output of the noise module, and the alarm module when the location module is in closer proximity to the emergency.

* * * * *